United States Patent [19]

Rüb

[11] Patent Number: 4,883,092

[45] Date of Patent: Nov. 28, 1989

[54] MULTI-WAY CONTROL VALVE APPARATUS

[75] Inventor: Winfried Rüb, Neustadt/Main, Fed. Rep. of Germany

[73] Assignee: Mannesmann Rexroth GmbH, Lohr/Main, Fed. Rep. of Germany

[21] Appl. No.: 241,957

[22] Filed: Sep. 8, 1988

[30] Foreign Application Priority Data

Sep. 17, 1987 [DE] Fed. Rep. of Germany ..... 3731297

[51] Int. Cl.[4] ..... F15B 13/06

[52] U.S. Cl. ..... 137/625.65; 91/453; 91/464; 91/536; 137/625.66; 192/87.18

[58] Field of Search ..... 91/453, 464, 536; 137/625.65, 625.66; 192/87.18

[56] References Cited

U.S. PATENT DOCUMENTS 4,266,572 5/1981 Schuttenberg et al. ... 137/625.64 X

*Primary Examiner*—Gerald A. Michalsky

*Attorney, Agent, or Firm*—Burns, Doane, Swecker & Mathis

[57] ABSTRACT

A control valve apparatus is described which is intended for selective transmission of pressure to at least two pressure spaces. A magnetic control device is provided for selectively applying a hydraulic system pressure to the respective pressure spaces. As another function, the apparatus may simultaneously depressurize the two pressure spaces through the application of a control pressure to the control valve apparatus. To minimize the required installation space and the manufacturing cost, the control valve apparatus is comprised of a single control valve, the control piston means of which can be exposed to the control pressure against the force of a restoring device and can be moved into intermediate control positions by means of the magnetic control device.

9 Claims, 3 Drawing Sheets

MULTI-WAY CONTROL VALVE APPARATUS

FIELD AND BACKGROUND OF THE INVENTION

The invention relates to a control valve apparatus for selective transmission of pressure to at least two pressure spaces, e.g., two working spaces of piston-and-cylinder devices.

There are systems in which hydraulic control over two spaces, such as spaces associated with piston and cylinder devices, must be exercised so as to permit both of the spaces to be depressurized at the same time or to permit a first one of the spaces to be pressurized while the second is open to tank or to permit the second of the spaces to be pressurized while the first is connected to tank. The customary control valve apparatuses used for such systems require a substantial amount of installation space and involve substantial manufacturing costs.

Accordingly, an underlying object of the present invention is to provide a control valve apparatus which will perform the necessary functions reproducibly and reliably, with minimal required installation space and minimal manufacturing cost.

SUMMARY OF THE INVENTION

According to the invention, a single magnetically and pressure-actuated valve is employed for controlling the pressure spaces. This valve has a control piston slidable in a valve body to three different control positions, one of which is an end position provided by the action of a biassing spring or the like. The actions of the control pressure and a magnetic control device are superposed in predetermined fashion to provide the remaining two distinctly separate control positions for the control piston.

This arrangement enables use of only a single control valve, thereby substantially reducing the required installation space. The accompanying savings in materials contribute to reduced manufacturing costs, as does the elimination of a second valve housing bore. An additional advantage results from reduced pressure drops in the flow through the valve apparatus, the reductions being due to the inventive configuration of the valve apparatus. This is particularly consequential in applications in low-pressure hydraulic supply circuits, because in such applications there can be high volumetric flow rates of on the order of up to 20 liter/minute.

In a preferred embodiment, the structure of the valve apparatus is substantially simplified, because only one side of the control piston apparatus need be configured to accommodate the control by the magnetic control device and by the control pressure.

According to another feature of the invention, the individual control positions of the control valve apparatus can be separated by simple means and at low cost. More particularly, the magnetic control means can, in cooperation with the spring means, exert control over the reversal of system pressure as between the two spaces being controlled and the control pressure can act effectively on the control piston at any time to depressurize both spaces without interfering with or being influenced by the magnetic control device.

A preferred application of the control valve apparatus is to a power shifting mechanism for two shifting couplings. In such a transmission control, e.g., for a tractor transmission, the control valve apparatus must control volumetric flows at pressures on the order of 18 bar. It has been found that the control valve apparatus of this invention accomplishes this task with comparatively very low energy loss.

BRIEF DESCRIPTION OF THE DRAWINGS

Exemplary embodiments of the invention will now be described in greater detail with reference to the schematic drawings, in which.

DETAILED DESCRIPTION OF PREFERRED EMBODIMENT

Figure 1:
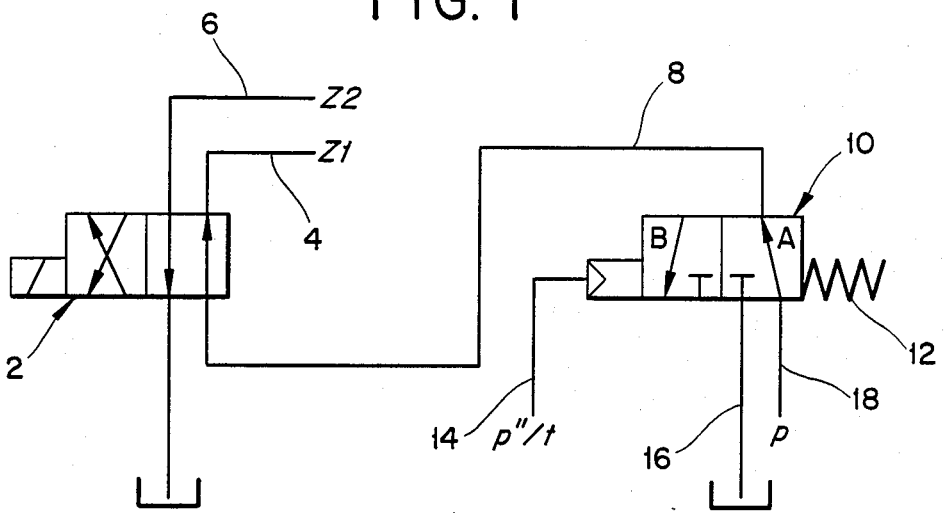
FIG. 1 is a block schematic diagram, representing a simplified teaching of a concept which is made use of in previously known arrangements.

Referring first to FIG. 1, it is to be noted that the achievement of all the functions of (1) selective pressurization of either of two cylinders and (2) simultaneous depressurization of both such cylinders has heretofore required complex arrangements. A 4/2-way magnetic control valve has been used for the selective control, as illustrated in FIG. 1, reference numeral 2. Lines 4 and 6 in FIG. 1 are the pressure supply lines for the cylinders Z1 and Z2. In order to accomplish the task of depressurizing both cylinders simultaneously, a pressure line 8 at the system pressure p is connected to a 3/2-way valve 10 the sliding valve body of which is exposed to a control pressure line 14 at either the tank pressure [t] or to a control pressure p″. The valve body is acted on by the force of an adjusting spring 12.

If no control pressure p′ is applied, the valve body is maintained in control position A, so that the system pressure p is applied to one of the two cylinders Z1 and Z2 depending on the position of the magnetic control valve 2. If the control pressure line 14 is switched from the tank to the control pressure p″, the sliding valve body of the 3/2-way valve 10 is moved to position B, wherewith the supply line 18 is blocked and the pressure line 8 is connected to a tank connecting line 16.

Figure 2:
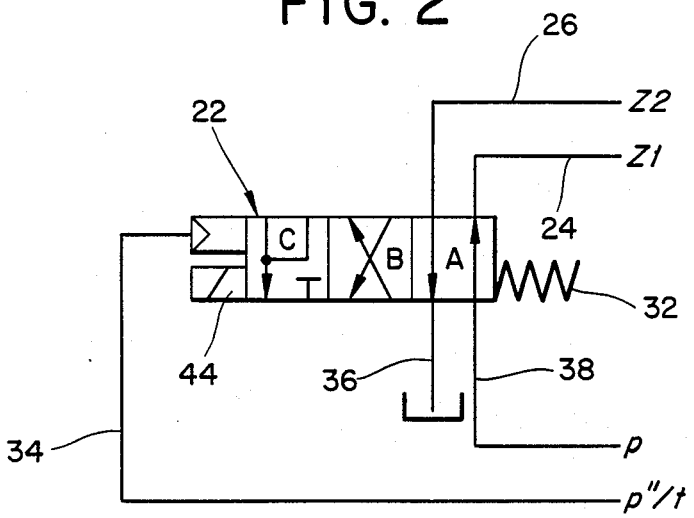
FIG. 2 is a block schematic diagram of the control valve apparatus according to the present invention.

FIG. 2 shows control valve apparatus according to the present invention for selectively controlling two cylinders Z1 and Z2. It is comprised of a 4/3-way control valve 22 the control piston means of which is in the form of a sliding valve body which can be acted on in one direction (right to left in FIG. 2) by a return spring 32, and in the opposite direction by the control pressure p″ in the control pressure line 34. Additionally, the sliding valve body is controlled by a magnetic control device 44 which acts on the sliding valve body on the same side as the control pressure p″. This engagement position of the device 44 is not obligatory, but is preferable.

The control positions of the valve 22 are designated A, B, and C. In control position A, which may be a detent position determined by the return spring 32, the pressure supply line 24 leading to the cylinder Z1 is connected to a supply line 38 at the system pressure. In this state the control pressure line 34 is connected to the tank, and the magnetic control device is not activated. A pressure supply line 26 for the cylinder Z2 is connected to a tank line 36.

If the magnetic control device 44 is activated, the sliding valve body assumes control position B wherein the pressure supply line 26 is exposed to the system pressure p and the pressure supply line 24 is connected to the tank. In the control pressure line 34 the control pressure p″ is still not present.

If it is desired to simultaneously depressurize the pressure spaces of the cylinders Z1 and Z2 (which pressure spaces will not be described in detail here), the control pressure p″ is applied to the control pressure line 34. Pressure p″ is adjusted such that it moves the valve 22 into the third distinct control position C regardless of the momentary position of said valve. Position C is preferably a detent position. In this control position C both pressure supply lines 24 and 26 are depressurized, and the supply line 38 is blocked off.

Figure 3A:
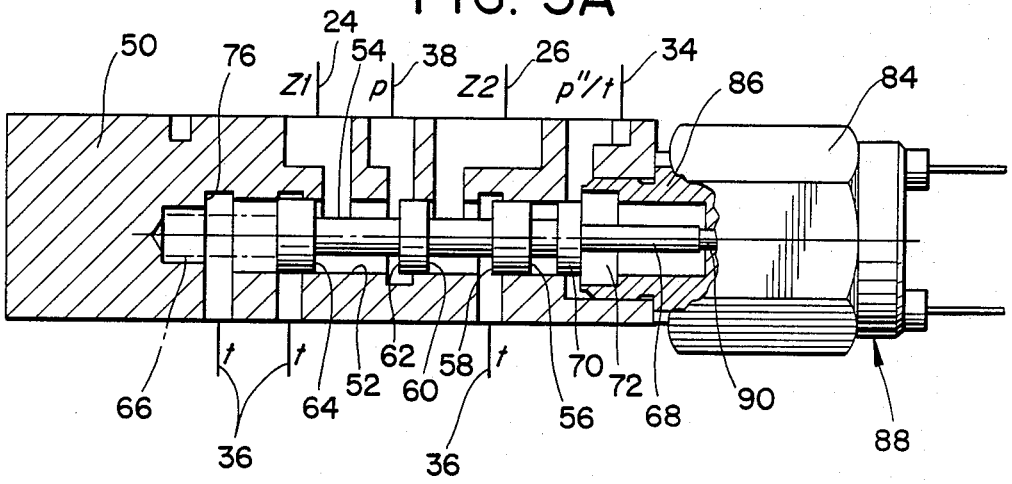
FIGS. 3A to 3C are schematic cross sectional views of a control valve according to FIG. 2 configured as a 4/3-way control valve, with the magnetic control device being omitted in FIGS. 3B and 3C to simplify the representation.
Figure 3B:
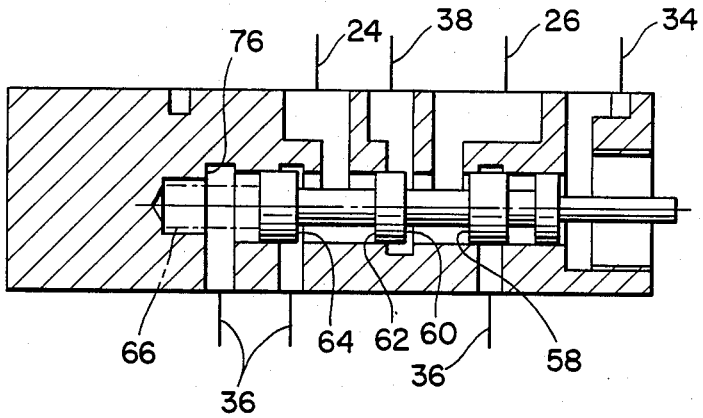
Figure 3C:
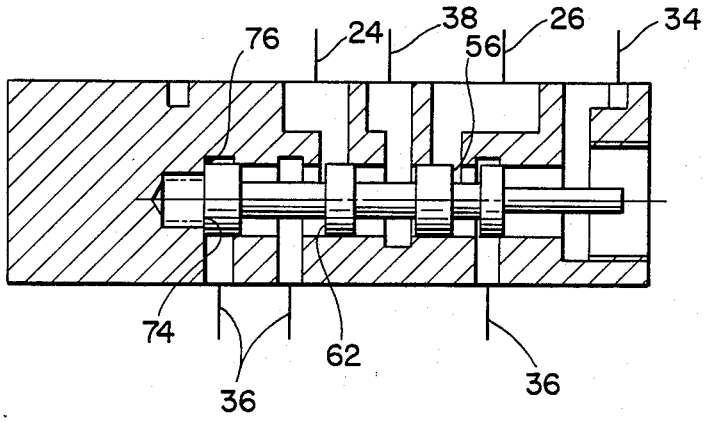

In FIGS. 3A to 3C the three control positions (A, B, C) of an embodiment of the 4/3-way valve are illustrated individually. A bore 52 is provided in a valve housing 50, for accommodating a control piston 54 having five control edges (56, 58, 60, 62, 64) which interact with corresponding valve connections. The hydraulic lines and connections which correspond to the lines and connections shown in FIG. 2 are assigned the same respective reference numerals as in FIG. 2.

The bore 52 is in the form of a blind bore with a return spring 66 mounted at its base. The right side of the bore in FIG. 3A is provided with a magnetic control device 84 illustrated only in FIG. 3A which is connected to the housing 50 by screw threads. A positioning member 68 on the control piston extends into the device 84. A control chamber 72 is formed between a piston flange 70 and a housing 86 of the control magnet 88, which magnet operates in oil. Chamber 72 is connected to the control pressure line 34. The positioning member 68 is in engagement with a motion transmitting member 90 in the control magnet 88 by which the control piston is stepwise movable from the position shown in FIG. 3A to that shown in FIG. 3B. That is, when the magnet 88 is energized it moves a member 90 a fixed distance to the left in FIG. 3A to push the positioning member 68 of the piston to the left a distance corresponding to the positional difference indicated by a comparison of FIG. 3A with FIG. 3B.

In control position A (FIG. 3A) the control pressure chamber 72 is unpressurized, and the magnetic control device 84 is not activated. The control edge 58 provides an open link between the tank line 36 and the pressure supply line 26. The system pressure supply line 38 is open to the pressure supply line 24 via the control edge 62.

If the magnetic control device 84 is activated, the control piston 54 is moved leftward into the position illustrated in FIG. 3B, wherein the control edge 58 closes off the connection between the pressure supply line 26 and the tank, and the control edge 60 provides an open link between the supply line 38 and the line 26. At the same time, the pressure supply line 24 is connected to the tank via control edge 64.

For depressurization of the two cylinders Z1 and Z2, the control pressure line 34 is exposed to a control pressure P″. This causes the control piston to be moved farther leftward, into the third distinct control position C, shown in FIG. 3C, wherein the flange 74 of the control piston rests against a shoulder 76 of the bore. In this control position, the control edges 56 and 62 provide open links from the pressure supply lines 26 and 24, respectively, to the tank. The control edges 58 and 60 close off the supply line 38 which is at the system pressure.

Preferably, the engagement between the magnetic control device 84 and the positioning member 68 is arranged such that it provides no resistance to the sliding movement of the control piston 54 into the control position C. This can be achieved by enabling the control magnet 88 to be operated in oil, so that there is no need to seal the positioning member 68 to the exterior.

If the control pressure p″ ceases to be applied, the control piston 54 is moved rightward by the force of the return spring 66 into the control position corresponding to the current activation state of the magnetic control device.

Figure 4:
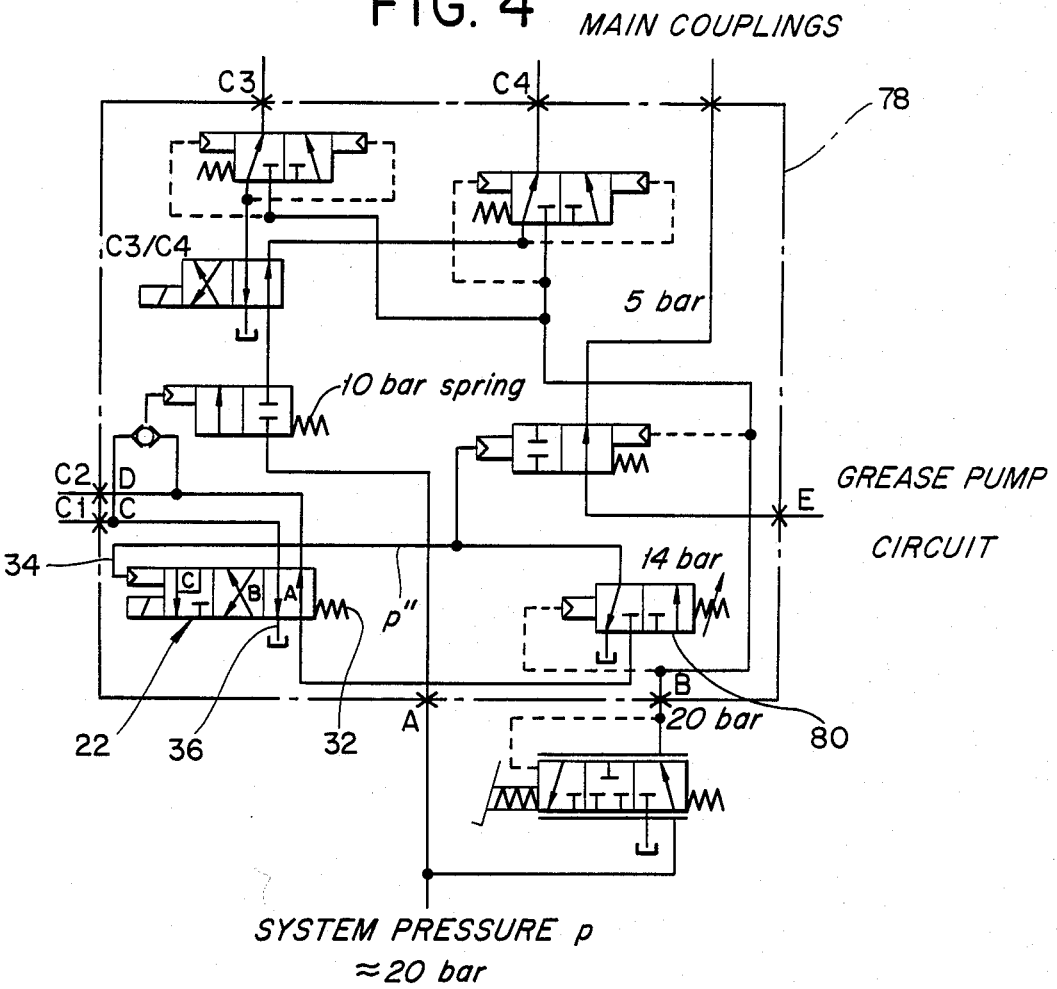
FIG. 4 is a block schematic diagram of a hydraulic control circuit incorporating a control valve apparatus according to FIG. 2.

In FIG. 4 a hydraulic control circuit is illustrated which can advantageously incorporate the above-described control valve apparatus. The control circuit 78 is part of a drive control system for a power shifting mechanism such as may be employed, e.g., for a tractor. In this case the 4/3-way valve 22 is used for selective control of two couplings C1 and C2. The components corresponding to those illustrated in FIGS. 2 and 3 have been assigned the same respective reference numerals. The control valve 22 is in the control position A shown in FIG. 4 if the control pressure line 34 is linked to the tank via a 3/2-way valve 80 and if the magnetic control device 44 is not activated. In this control position (A), the coupling C2 is engaged and the coupling C1 remains disengaged.

When the magnetic control device 44 is activated, the pressurization states of the couplings C1 and C2 are reversed. That is, coupling C2 becomes disengaged and coupling C1 becomes engaged.

In the second control position of the 3/2-way control valve 80, a control pressure p″ is established in the control pressure line 34, whereby both couplings C1 and C2 are disengaged.

Figure 5:
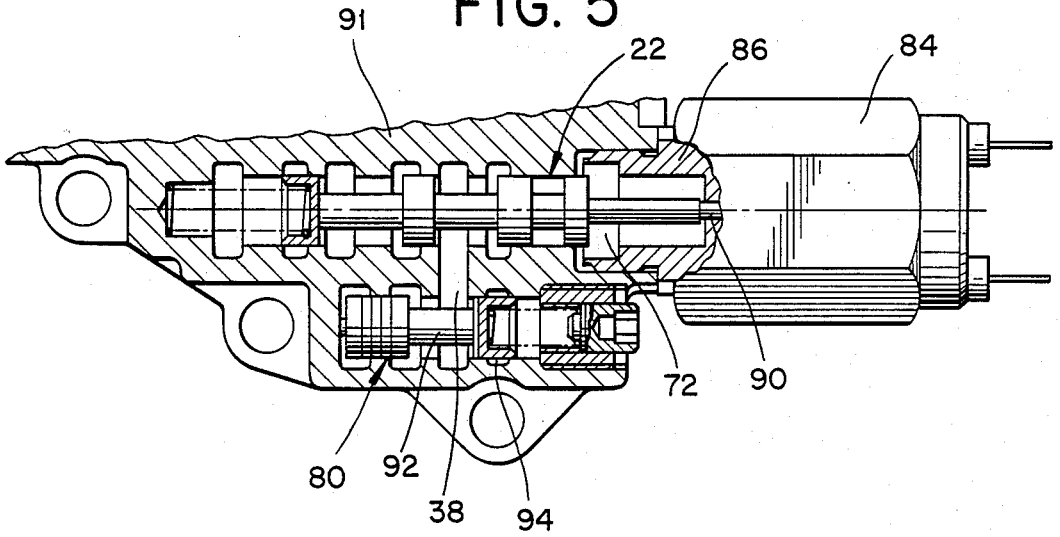
FIG. 5 is a cross sectional view of a part of a valve housing wherein the control valve according to FIG. 3 is housed.

In FIG. 5 it is shown how the control valve 22 and the 3/2-way valve 80 according to FIG. 4 can be integrated into a common valve housing 90. The control valve 22 is again shown in an embodiment of a 4/3-way valve similar to that of FIG. 3A. Accordingly, corresponding parts have been labeled with the same respective reference numerals. A sliding valve body 92 of the 3/2-way valve 80 blocks off the system pressure p which prevails in the supply line space 38 and prevents its access to a ring-shaped space 94 which is connected to the control pressure line 34. If the sliding valve body 92 of FIG. 5 is moved rightward, the control pressure line 34 is exposed to the system pressure p which then can be active in the control pressure chamber 72.

The invention is obviously not limited to the exemplary embodiments described hereinabove. Thus, e.g., it is possible to selectively control conditions in more than two pressure spaces. It is also not necessary that the control pistons be moved into end-detent positions; rather, these positions can be stabilized by means other than detents. The control piston apparatus may be comprised of a plurality of parts, and these may be accommodated in a single bore. Finally, it is also possible for the magnetic control device 44 to engage the control piston apparatus at a different position from that shown in the examples.

To sum up, the invention provides a control valve apparatus for selective transmission of pressure to at least two pressure spaces of working aggregates, and also (as a second function) for simultaneous depressurization of the pressure spaces. Means are provided wherein a control pressure is applicable to the control valve apparatus for the purpose of depressurization of said pressure spaces. To reverse the connections of a hydraulic system pressure to the respective pressure spaces, a magnetic control device is provided. To minimize the required installation space and the manufacturing costs, the control valve apparatus is comprised of a single control valve, the control piston device of which can be exposed to the control pressure against the force of a restoring device and can be moved into intermediate control positions by means of the magnetic control device.

What is claimed is:

1. A control valve apparatus for use in a hydraulic system of a type in which there are at least two working spaces and in which the control valve apparatus enables selective transmission of pressure to each of said working spaces and also selective depressurizing of all of said working spaces simultaneously, said apparatus including a single control valve having a body and control piston means slidable in said body, a restoring device for biasing said control piston means in one direction, a magnetic control device for moving said control piston means to an intermediate control position, and a control pressure system for moving said control piston means against the force of said restoring device.

2. A control valve apparatus according to claim 1, wherein the control pressure system and the magnetic control device can functionally act on the same side of the control piston means.

3. A control valve apparatus according to claim 1, wherein the control valve apparatus comprises a single control piston.

4. A control valve apparatus according to claim 1, wherein the control piston means can be sequentially moved by the magnetic control device into the individual control positions whereby said working spaces are acted on by the system pressure, and when the control pressure system is applied, the control piston means is moved into a separate position.

5. A control valve apparatus according to claim 4, wherein said last mentioned separate position is a detent position.

6. A control valve apparatus according to claim 1, wherein the control valve comprises a 4/3-way valve to selectively link system pressure to two pressure or working spaces.

7. A control valve apparatus according to claim 1, wherein a first control position of said control piston means is determined by the restoring device, wherein at least one other control position of said control piston means is determined by said magnetic control device, and wherein a separate additional position of said control piston means is determined by said control pressure system.

8. A control valve apparatus according to claim 1, wherein the restoring device comprises a return spring.

9. A hydraulic system embodying control valve apparatus according to claim 1, said hydraulic system including a control circuit providing a system pressure of up to about 20 bar to a power shifting mechanism for two shifting couplings.

* * * * *